US005937243A

United States Patent [19]

Liu et al.

[11] Patent Number: 5,937,243

[45] **Date of Patent: *Aug. 10, 1999**

[54] IMAGE-WISE TONER LAYER CHARGING VIA AIR BREAKDOWN FOR IMAGE DEVELOPMENT

[75] Inventors: Chu-heng Liu; Weizhong Zhao, both of Webster, N.Y.

[73] Assignee: Xerox Corporation, Stamford, Conn.

[ * ] Notice: This patent is subject to a terminal disclaimer.

[21] Appl. No.: 08/884,236

[22] Filed: Jun. 27, 1997

[51] Int. Cl.[6] ..... G03G 15/00; G03G 13/00

[52] U.S. Cl. ..... 399/130; 399/133; 399/154; 430/48

[58] Field of Search ..... 399/133, 134, 399/136, 154, 237, 130; 347/120, 140, 151, 159; 430/48, 54, 117, 126

[56] References Cited

U.S. PATENT DOCUMENTS

| | | | |
|---|---|---|---|
| 3,519,818 | 7/1970 | Bean | 430/126 |
| 3,776,722 | 12/1973 | Cantarano | 430/126 |
| 3,849,126 | 11/1974 | Cantarano | 430/126 |
| 4,504,138 | 3/1985 | Kuehnle et al. | 355/10 |
| 5,387,760 | 2/1995 | Miyazawa et al. | 118/661 |
| 5,436,706 | 7/1995 | Landa et al. | 355/256 |
| 5,619,313 | 4/1997 | Domoto et al. | 399/233 |

*Primary Examiner*—Joan Pendegrass

[57] ABSTRACT

A novel image development method and apparatus are disclosed, whereby image-wise charging of a toner layer is accomplished by induce air breakdown electrical discharge such that free mobile ions are introduced in the vicinity of an electrostatic latent image coated with a layer of developing material. The latent image causes the free mobile ions to flow in an image-wise ion stream corresponding to the latent image, which, in turn, leads to image-wise charging of the toner layer, such that the toner layer itself becomes the latent image carrier. The latent image carrying toner layer is subsequently developed and transferred to a copy substrate to produce an output document.

91 Claims, 4 Drawing Sheets

IMAGE-WISE TONER LAYER CHARGING VIA AIR BREAKDOWN FOR IMAGE DEVELOPMENT

The present invention relates generally to electrostatic latent image development, and, more particularly, concerns an apparatus and method for developing an electrostatic latent image having a layer of marking material coated thereon by selectively applying charges potential to the toner layer via air breakdown to create an image-wise charged toner layer capable of being developed and selectively separated for producing an output image corresponding thereto.

Generally, processes for electrostatographic copying and printing are initiated by selectively charging and/or discharging a charge receptive imaging member in accordance with an original input document or an imaging signal, generating an electrostatic latent image on the imaging member. This latent image is subsequently developed into a visible image by a process in which charged developing material is deposited onto the surface of the latent image bearing member, wherein charged particles in the developing material adhere to image areas of the latent image. The developing material typically comprises carrier granules having toner particles adhering triboelectrically thereto, wherein the toner particles are electrostatically attracted from the carrier granules to the latent image areas to create a powder toner image on the imaging member. Alternatively, the developing material may comprise a liquid developing material comprising a carrier liquid having pigmented marking particles (or so-called toner solids) charge director materials dissolved therein, wherein the liquid developing material is applied to the latent image bearing imaging member with the marking particles being attracted to the image areas of the latent image to form a developed liquid image. Regardless of the type of developing material employed, the toner or marking particles of the developing material are uniformly charged and are electrostatically attracted to the latent image to form a visible developed image corresponding to the latent image on the imaging member. The developed image is subsequently transferred, either directly or indirectly, from the imaging member to a copy substrate, such as paper or the like, to produce a "hard copy" output document. In a final step, the imaging member is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface (see, for example, U.S. Pat. No. 4,267,556 and 4,885,220, among numerous other patents and publications), as well as other electrostatic printing systems wherein a charge carrying medium is adapted to carry an electrostatic latent image. It will be understood that the instant invention applies to all various types of electrostatic printing systems and is not intended to be limited by the manner in which the image is formed on the imaging member or the nature of the latent image bearing member itself.

As described hereinabove, the typical electrostatographic printing process includes a development step whereby developing material is physically transported into contact with the imaging member so as to selectively adhere to the latent image areas thereon in an image-wise configuration. Development of the latent image is usually accomplished by electrical attraction of toner or marking particles to the image areas of the latent image. The development process is most effectively accomplished when the particles carry electrical charges opposite in polarity to the latent image charges, with the amount of toner or marking particles attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

Image quality in electrostatographic printing applications may vary significantly due to numerous conditions affecting latent image formation as well as development, among various other factors. In particular, image development can be effected by charge levels, both in the latent image, as well as in the developing material. For example, when the charge on dry toner particles becomes significantly depleted, binding forces with the carrier also become depleted, causing an undesirable increase in image development, which, in turn, causes the development of the latent image to spread beyond the area defined thereby. Similarly, one problem affecting the control of image quality in ionographic devices involves a phenomenon known as "image blooming" resulting from the effect of previously deposited ions or charge on the path of subsequent ions directed to the charge retentive surface. This problem is particularly noticeable when printing characters and edges of solid areas, resulting in character defects, wherein blooming artifacts may include picture elements being displaced by 1–2 pixels in distance. Image blooming can also be caused by poor charge retention and/or charge migration in the electrostatic latent image on the latent image bearing member, a problem which is particularly prevalent in ionographic systems, wherein a focused beam ion source is utilized for image-wise charging of a dielectric latent image bearing member.

The present invention contemplates a novel electrostatographic imaging process wherein an electrostatic latent image bearing member having a layer of marking material coated thereon is selectively charged in an imagewise manner to create a secondary latent image corresponding to the electrostatic latent image on the imaging member. Image-wise charging is accomplished by inducing the ionization of air via a phenomenon known as air breakdown for introducing free mobile ions in the vicinity of the electrostatic latent image coated with the layer of toner particles. The formation of electrostatic charge patterns by electrical discharges involves the phenomena of ionic conduction through gases. It is known that when two conductors are held near each other with a voltage applied between the two, electrical discharge will occur as the voltage is increased to the point of air breakdown. This discharge is usually accompanied by a visible spark. However, when the conductors are very close together (a few thousands of an inch) discharge can take place without sparking and electrical charges will be collected on a receiving surface during discharges. The latent image causes the free mobile ions to flow in an image-wise ion stream corresponding to the latent image.

These ions, in turn, are captured by the marking material in the layer, leading to image-wise charging of the marking layer with the marking material layer itself becoming the latent image carrier. The latent image carrying toner layer is subsequently developed by selectively separating image areas of the toner layer and transferring the separated image to a copy substrate for producing an output document.

The following disclosures may be relevant to some aspects of the present invention:

U.S. Pat. No. 4,504,138
Patentee: Kuehnle et al.
Issued: Mar. 12, 1985

U.S. Pat. No. 5,387,760
Patentee: Miyazawa et al
Issued: Feb. 7, 1995

U.S. Pat. No. 5,436,706
Patentee: Landa et al.
Issued: Jul. 25, 1995

U.S. Pat. No. 5,619,313
Patentee: Domoto et al.
Issued: Apr. 8, 1997

The relevant portions of the foregoing patents may be briefly summarized as follows:

U.S. Pat. No. 4,504,138 discloses a method of developing a latent electrostatic charge image formed on a photoconductor surface comprising the steps of applying a thin viscous layer of electrically charged toner particles to an applicator roller preferably by electrically assisted separation thereof from a liquid toner suspension, defining a restricted passage between the applicator roller and the photoconductor surface which approximates the thickness of the viscous layer, and transferring the toner particles from the applicator roller at the photoconductor surface due to the preferential adherence thereof to the photoconductor surface under the dominant influence of the electric field strength of the electrostatic latent image carried by the photoconductive surface, the quantity of toner particles transferred being proportional to the relative incremental field strength of the latent electrostatic image. An apparatus for carrying out the method of the invention is also disclosed, which includes an applicator roller mounted for rotation in a container for toner suspension, an electrode arranged adjacent the circumferential surface of the roller to define an electrodeposition chamber therebetween and electrical connections between the roller, the electrode and a voltage source to enable electrolytic separation of toner particles in the chamber, forming a thin highly viscous layer of concentrated toner particles on the roller.

U.S. Pat. No. 5,387,760 discloses a wet development apparatus for use in a recording machine to develop a toner image corresponding to an electrostatic latent image on an electrostatic latent image carrier. The apparatus includes a development roller disposed in contact with or near the electrostatic latent image carrier and an application head for applying a uniform layer of the wet developer to the roller.

U.S. Pat. No. 5,436,706 discloses an imaging apparatus including a first member having a first surface having formed thereon a latent electrostatic image, wherein the latent electrostatic image includes image regions at a first voltage and background regions at a second voltage. A second member charged to a third voltage intermediate the first and second voltages is also provided, having a second surface adapted for resilient engagement with the first surface. A third member is provided, adapted for resilient contact with the second surface in a transfer region. The imaging apparatus also includes an apparatus for supplying liquid toner to the transfer region thereby forming on the second surface a thin layer of liquid toner containing a relatively high concentration of charged toner particles, as well as an apparatus for developing the latent image by selective transferring portions of the layer of liquid toner from the second surface to the first surface.

U.S. Pat. No. 5,619,313 discloses a method and apparatus for simultaneously developing and transferring a liquid toner image. The method includes the steps of moving a photoreceptor including a charge bearing surface having a first electrical potential, applying a uniform layer of charge having a second electrical potential onto the charge bearing surface, and image-wise dissipating charge from selected portions on the charge bearing surface to form a latent image electrostatically, such that the charge-dissipated portions of the charge bearing surface have the first electrical potential of the charge bearing surface. The method also includes the steps of moving an intermediate transfer member biased to a third electrical potential that lies between said first and said second potentials, into a nip forming relationship with the moving imaging member to form a process nip. The method further includes the step of introducing charged liquid toner having a fourth electrical potential into the process nip, such that the liquid toner sandwiched within the nip simultaneously develops image portions of the latent image onto the intermediate transfer member, and background portions of the latent image onto the charge bearing surface of the photoreceptor.

In accordance with one aspect of the present invention, an imaging apparatus is provided, comprising means for inducing air breakdown in the vicinity of a marking material layer to create a latent image including image and non-image areas in the toner layer, and means for developing or selectively separating the latent image bearing toner layer such that the image areas reside on a first surface and the non-image areas reside on a second surface.

In accordance with another aspect of the present invention, an imaging process is provided, comprising the steps of inducing air breakdown in the vicinity of a marking material layer corresponding to an electrostatic latent image to create a secondary latent image including image and non-image areas in the marking material layer, and selectively separating the latent image bearing toner layer such that the image areas reside on a first surface and the non-image areas reside on a second surface.

In accordance with another aspect of the present invention, there is provided an image development apparatus, comprising: means for generating a first electrostatic latent image on an imaging member; means for depositing a toner layer on the imaging member or a second surface of a second member, and means for inducing air breakdown to create an electrical discharge in the vicinity of the electrostatic latent image so as to generate a second latent image in the toner layer in response to the first electrostatic latent image on the imaging member.

In accordance with another aspect of the present invention, there is provided a process for image development, comprising the steps of generating a first electrostatic latent image on an imaging member, depositing a marking layer on the imaging member or a second surface of a second member, and inducing air breakdown to create an electrical discharge in the vicinity of the electrostatic latent image so as to generate a second latent image in the toner layer in response to the first electrostatic latent image on the imaging member.

In accordance with another aspect of the present invention, there is provided an image development apparatus, comprising means for image-wise charging of a toner layer via air breakdown to introduce free mobile ions in the vicinity of an electrostatic latent image adjacent to a layer of developing material, whereby the electrostatic latent image causes the free mobile ions to flow to the toner layer in an image-wise ion stream corresponding to the latent image, creating a secondary latent image in the toner layer. Means are also provided for developing the secondary latent image by selectively separating image portions from the non-image portions of the marking material layer and further transferring the developed image to a copy substrate for producing an output document.

In accordance with another aspect of the present invention, an imaging apparatus, comprising an imaging member for having an electrostatic latent image formed thereon is provided. The imaging member includes a surface capable of supporting marking material. An imaging device is also provided for generating the electrostatic latent image on the imaging member, wherein the electrostatic latent image includes image areas defined by a first charge voltage and non-image areas defined by a second charge voltage distinguishable from the first charge voltage. A marking material supply apparatus is also provided for depositing marking material on the surface of the imaging member to form a marking material layer thereon adjacent the electrostatic latent image on the imaging member. In addition, an ion source is provided for selectively delivering ions to the marking material layer in an image-wise manner responsive to the electrostatic latent image on the imaging member to form a secondary latent image in the marking material layer having image and non-image areas corresponding to the electrostatic latent image on said imaging member. A separator member is also provided for selectively separating portions of the marking material layer in accordance with the secondary latent image in the marking material layer to create a developed image corresponding to the electrostatic latent image formed on said imaging member.

In accordance with another aspect of the present invention, an imaging process is provided, comprising the steps of: generating an electrostatic latent image on an imaging member having a surface capable of supporting marking material, wherein the electrostatic latent image includes image areas defined by a first charge voltage and non-image areas defined by a second charge voltage distinguishable from the first charge voltage; depositing marking material on the surface of the imaging member to form a marking material layer thereon adjacent the image and non-image areas of the electrostatic latent image; selectively delivering ions to the marking material layer in an image-wise manner responsive to the electrostatic latent image on the imaging member for forming a secondary latent image in the marking material layer having image and non-image areas corresponding to the electrostatic latent image on the imaging member; and selectively separating portions of the marking material layer from the imaging member in accordance with the secondary latent image in the marking material layer for creating a developed image corresponding to the electrostatic latent image formed on the imaging member.

These and other aspects of the present invention will become apparent from the following description in conjunction with the accompanying drawings in which.

Figure 3:
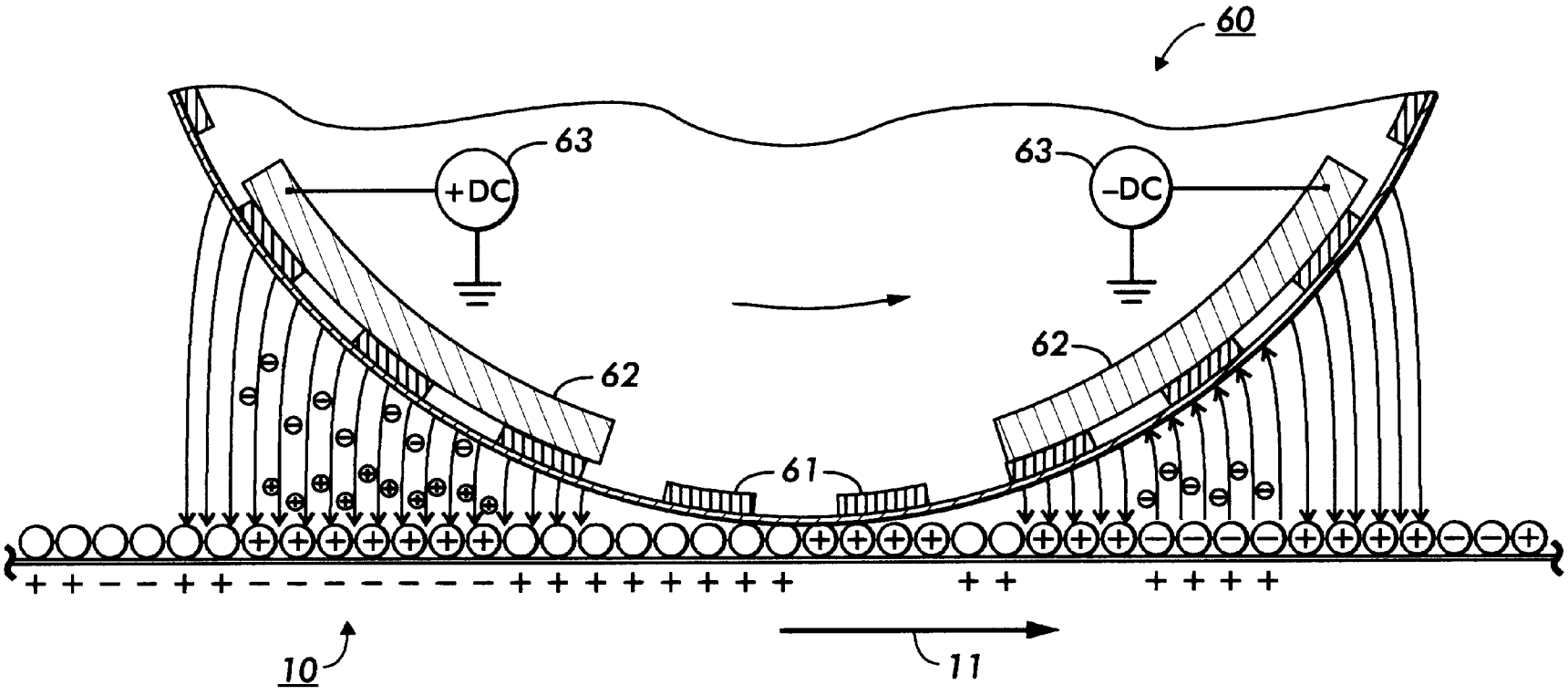
Figure 4:
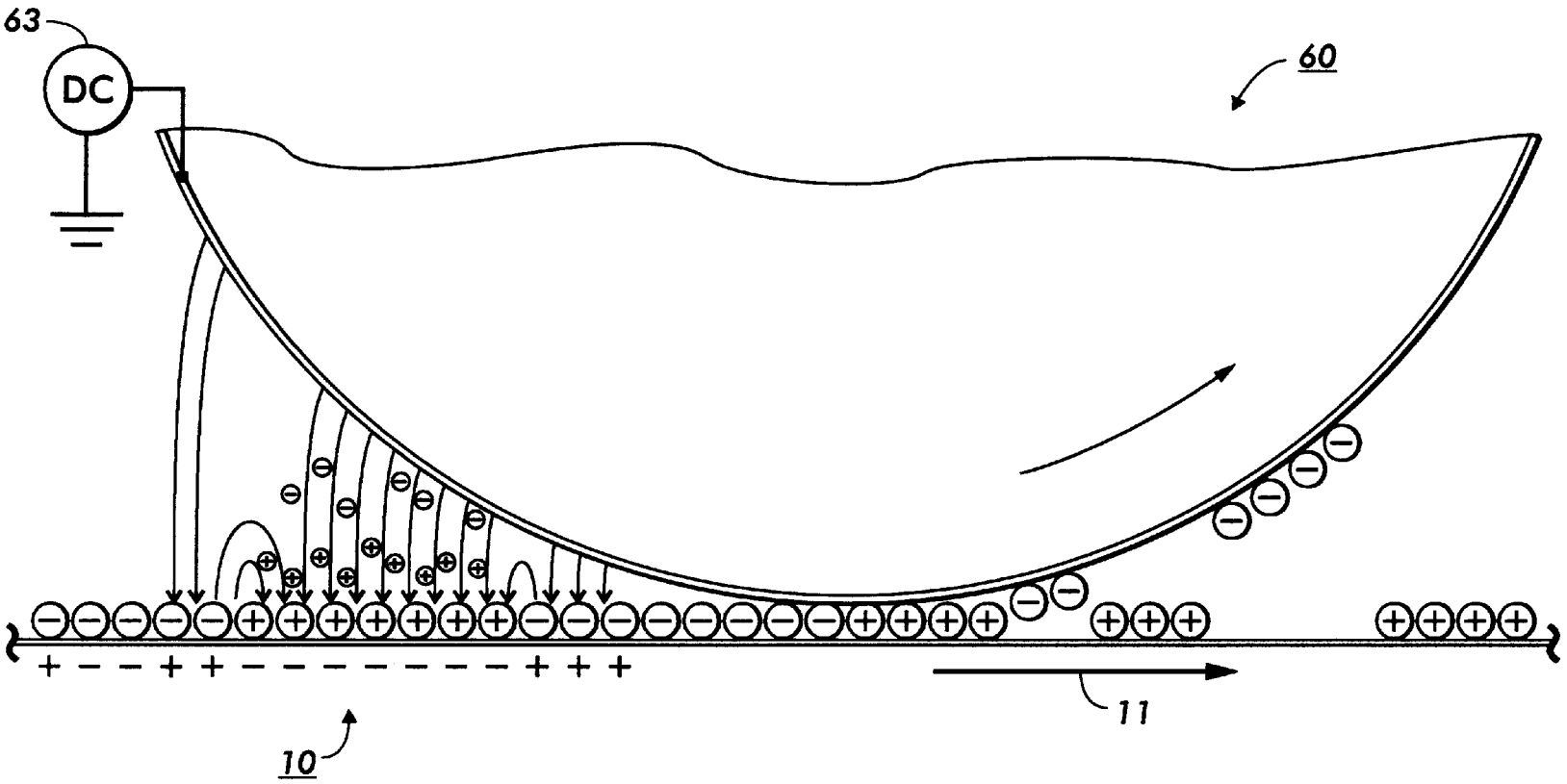

FIG. 3 is an exploded view illustrating image-wise toner layer charging via air breakdown, wherein a neutrally charged toner layer is selectively charged in an image-wise manner, as contemplated by a second embodiment of the present invention; and FIG. 4 is an exploded view illustrating image-wise toner layer charging via air breakdown, and image separation using a singular biased roll member, as contemplated by an additional embodiment of the present invention.

For a general understanding of the features of the present invention, reference is made to the drawings, wherein like reference numerals have been used throughout to identify identical or similar elements. Initially, a system and process for accomplishing image-wise toner layer charging via air breakdown and selective separation or transfer of the image-wise charged toner layer in accordance with the present invention will be described with reference to FIG. 1. While the present invention will be described in terms of an illustrative embodiment or embodiments, it will be understood that the invention is adaptable to a variety of copying and printing applications, such that the present invention is not necessarily limited to the particular embodiment or embodiments shown and described herein. On the contrary, the following description is intended to cover all alternatives, modifications, and equivalents, as may be included within the spirit and scope of the invention as defined by the appended claims.

Figure 1:
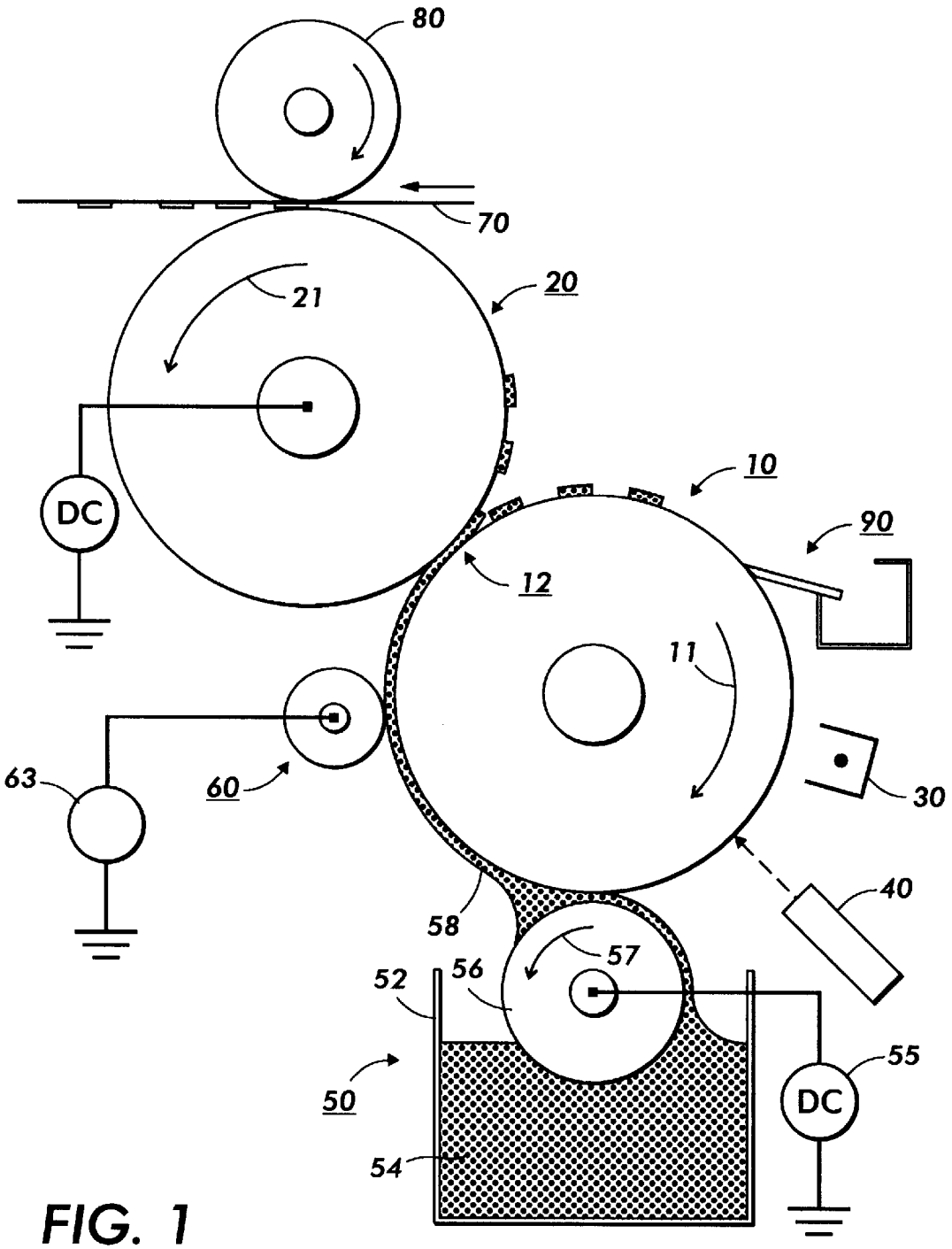
FIG. 1 is a simple schematic illustration depicting a system and process for image-wise toner layer charging via air breakdown and image development in accordance with the present invention.

Moving now to FIG. 1, an exemplary imaging apparatus capable of image-wise toner charging via air breakdown in accordance with the present invention is shown, comprising an assemblage of operatively associated image forming elements, including an imaging member 10 situated in contact with an image separating member 20 at an image separating nip 12 formed therebetween. Imaging member 10 includes an imaging surface of any type capable of having an electrostatic latent image formed thereon. An exemplary imaging member 10 may include a typical photoconductor or other photoreceptive component of the type known to those of skill in the art in electrophotography, wherein a surface layer having photoconductive properties is supported on a conductive support substrate. Although the following description will describe by example a system and process in accordance with the present invention incorporating a photoconductive imaging member, it will be understood that the present invention contemplates the use of various alternative embodiments for imaging member 10 as are well known in the art of electrostatographic printing, including, for example, but not limited to, non-photosensitive imaging members such as a dielectric charge retaining member of the type used in ionographic printing machines, or electroded substructures capable of generating charged latent images.

Imaging member 10 is rotated, as indicated by arrow 11, so as to transport the surface thereof in a process direction for implementing a series of image forming steps in a manner similar to typical electrostatographic printing processes. Initially, in the exemplary embodiment of FIG. 1, the photconductive surface of imaging member 10 passes through a charging station, which may include a corona generating device 30 or any other charging apparatus for applying an electrostatic charge to the surface of the imaging member 10. The corona generating device 30 is provided for charging the photoconductive surface of imaging member 10 to a relatively high, substantially uniform potential. It will be understood that various charging devices, such as charge rollers, charge brushes and the like, as well as induction and semiconductive charge devices, among other devices which are well known in the art, may be incorporated into the charging station for applying a charge potential to the surface of the imaging member 10.

After the imaging member 10 is brought to a substantially uniform charge potential, the charged surface thereof is advanced to an image exposure station, identified generally by reference numeral 40. The image exposure station projects a light image corresponding to the input image onto the charged photoconductive surface. In the case of an imaging system having a photosensitive imaging member, as currently described, the light image projected onto the surface of the imaging member 10 selectively dissipates the charge thereon for recording an electrostatic latent image on the photoconductive surface. The electrostatic latent image comprises image areas defined by a first charge voltage and non-image areas defined by a second charge voltage in image configuration corresponding to the input image informational areas. The image exposure station 40 may incorporate various optical image formation and projection components as are known in the art, and may include various well known light lens apparatus or digital scanning system for forming and projecting an image from an original input document onto the imaging member 10. Alternatively, various other electronic devices known in the art may be utilized for generating an electronic information signal for creating the electrostatic latent image on the imaging member. It will be understood that the electrostatic latent image may be comprised of image and non-image areas that are defined areas having opposite charge polarities or by areas that merely have first and second distinguishable charge potential levels.

In a typical electrostatographic printing process, after the electrostatic latent image is generated on the surface of the imaging member 10, the image would be developed into a visible image on the surface of the imaging member 10 by selectively attracting charged toner particles to areas of the latent image thereon. By contrast, in the present invention, a layer of charged or uncharged toner particles is deposited on the entire surface of the latent image bearing imaging member 10. To that end, a toner supply apparatus or applicator 50 is provided, as depicted in the exemplary embodiment of FIG. 1, whereby a layer of charged or uncharged toner particles (and possibly some carrier mechanism such as a liquid solvent) is transported onto the surface of the imaging member 10. The exemplary embodiment of FIG. 1 shows an illustrative toner applicator 50, wherein a housing 52 is adapted to accommodate a supply of toner particles 54 and any additional carrier material, if necessary. In an exemplary embodiment, the toner applicator 50 includes an applicator roller 56 which is rotated in a direction as indicated by arrow 57 to transport toner from housing 52 into contact with the surface of the imaging member 10, forming a substantially uniformly distributed layer of toner, or a so-called "toner cake", 58 thereon.

The toner cake 58 described above can be created in various ways. For example, depending on the materials utilized in the printing process, as well as other process parameters such as process speed and the like, a layer of toner particles having sufficient thickness, preferably on the order of between 2 and 15 microns and more preferably between 3 and 8 microns, may be formed on the surface of the imaging member 10 by merely providing adequate proximity and/or contact pressure between the applicator roller 56 and the imaging member 10. Alternatively, electrical biasing may be employed to assist in actively moving the toner particles onto the surface of the imaging member 10. Thus, in one exemplary embodiment, the applicator roller 56 can be coupled to an electrical biasing source 55 for implementing a so-called forward biasing scheme, wherein the toner applicator 56 is provided with an electrical bias of magnitude greater than both the image and non-image (background) areas of the electrostatic latent image on the imaging member 10, thereby creating electrical fields extending from the toner applicator roll 56 to the surface of the imaging member 10. These electrical fields cause toner particles to be transported to imaging member 10 for forming a substantially uniform layer of toner particles on the surface thereof.

It will be understood that numerous other devices or apparatus may be utilized for depositing toner layer 58 on the surface of the imaging member 10, including various well known apparatus analogous to development devices used in conventional electrostatographic applications, such as, but not limited to: powder cloud systems which transport developing material to the imaging member by means of a gaseous medium such as air; brush systems which transport developing material to the imaging member by means of a brush or similar member; and cascade systems which transport developing material to the imaging member by means of a system for pouring or cascading the toner particles onto the surface of the imaging member. In addition, various systems directed toward the transportation of liquid developing material having toner particles immersed in a carrier liquid, can be incorporated into the present invention. Examples of such liquid transport system can include a fountain-type device as disclosed generally in commonly assigned U.S. Pat. No. 5,519,473 (incorporated by reference herein), or any other system capable of causing a flow of liquid developing material, including toner particles immersed in a liquid carrier medium, onto the surface of the imaging member. It is noted that, in the case of liquid developing materials, it is desirable that the toner cake formed on the surface of the imaging member 10 should be comprised of at least approximately 10% by weight toner solids, and preferably in the range of 15%–35% by weight toner solids.

With respect to the foregoing toner cake formation process and various apparatus therefor, it will be understood that the presence of the latent image on the imaging member may generate some fringe fields in areas of interface between image and non-image areas of the latent image. However, these fringe fields are minimal relative to the fields associated with conventional electrostatic latent image development such that, although some toner layer nonuniformity may result, the toner layer 58 deposited on the imaging member 10 surface can be characterized as having a substantially uniform density per mass area in both image and background areas of the latent image. In fact it is not a requirement of the invention that the toner layer be uniform or even substantially uniformly distributed on the surface of the imaging member 10, so long as the toner layer covers, at a minimum, the desired image areas of the latent image.

In accordance with the present invention, after the toner layer 58 is formed on the surface of the electrostatic latent image bearing imaging member 10, the toner layer is charged in an image-wise manner by inducing ionization of the air in the vicinity of the toner layer on the electrostatic latent image bearing imaging member 10. Thus, in accordance with the present invention a biased roll member 60 is provided, situated adjacent the toner layer 58 on the imaging member 10, for introducing free mobile ions in the vicinity of the charged latent image to facilitate the formation of an image-wise ion stream extending from the roll member 60 to the latent image on the surface of the image bearing member 10, as will be described. The image-wise ion stream generates a secondary latent image in the toner layer 58 made up of oppositely charged toner particles in image configuration corresponding to the original latent image generated on the imaging member 10.

The process of generating a secondary latent image in the toner cake layer will be described in greater detail with respect to FIG. 2, where an initially charged toner cake 58 is illustrated, for purposes of simplicity only, as a uniformly distributed layer of negatively charged toner particles having the thickness of a single toner particle. The toner cake resides on the surface of the imaging member 10 which is shown as being transported from left to right past the biased roll member 60. The primary function of the biased roll member 60 is to provide free mobile ions in the vicinity of the imaging member 10 having the toner layer 58 and latent image thereon. As previously noted, it is known that when two conductors are held near each other with a voltage applied between the two, electrical discharge will occur as the voltage is increased to the point of air breakdown. Thus, at a critical point, a discharge current is created in the air gap between the conductors. This point is commonly known as the Paschen threshold voltage. When the conductors are very close together (a few thousandths of an inch) discharge can take place without sparking, such that a discharge current will be caused to flow across a gap between the roll member 60 and the tone layer 58. The present invention exploits of this phenomenon to induce image-wise charging.

In operation, the biased roll member 60 is coupled to an electrical biasing source 63 capable of providing an appropriate voltage potential to the roll member, sufficient to produce air breakdown in the vicinity of a latent image bearing imaging member. Preferably, the voltage applied to the roll 60 is maintained at a predetermined potential such that electrical discharge is induced only in a limited region where the surface of the roll member 60 and the imaging member 10 are in very close proximity and the voltage differential between the roll and the image and/or non-image areas of the latent image exceed the Paschen threshold voltage. In one preferred embodiment, which will be known as "one-way breakdown", it is contemplated that the bias applied to the roll 60 is sufficient to exceed the Paschen threshold voltage only with respect to either one of the image or non-image areas of the original latent image on the imaging member. Alternatively, in another embodiment, the bias applied to the roll 60 will be sufficient to exceed the Paschen threshold with respect to both the image or non-image areas of the original latent image. The air breakdown induced in this situation will can be caused to occur in a manner such that field lines are generated in opposite directions with respect to the image and non-image areas. For example, in the case where the Paschen threshold voltage is about 400 volts, and the image and non-image areas have voltage potentials of about 0 and −1200 volts respectively, a bias potential applied to roll 60 of approximately −200 volts will result in air breakdown that generates charges only in the region of the non-image areas such that the toner particles adjacent to this region will be effected. Conversely, a bias of −1000 volts applied to roll 60, for example, will result in charge generation in the region of the image area of the latent image, with ions flowing in the opposite direction. In yet another alternative, a bias of approximately −600 volts applied to roll 60 will result in charge generation in the areas adjacent both image and non-image areas with ions flowing in opposite directions. This so-called 2-way air breakdown mode is illustrated in FIG. 2, wherein electrical discharge via air breakdown is induced in a pre-nip region immediately prior to a nip region created by contact between the imaging member 10 and the roll member 60. The electrical discharge causes electrostatic fields to develop between the roll member 60 and the imaging member 10 in the pre-nip region. In turn, the force of these fields causes the air to become ionized, generating free mobile ions which are directed toward the imaging member 10. The magnitude of the bias potential applied to the roll member 60 operates to control the image-wise ionization and the amount of charge and the charge uniformity applied to the imaging surface 10. Thus, in accordance with the example described above, 2-way air breakdown can be induced by applying a bias voltage to roll 60 which is sufficient to exceed the Paschen threshold with respect to both image and non-image areas of a latent image on an imaging member brought into the vicinity of the roll 60. Providing that this bias applied to roll 60 in a range intermediate to the potential associated with the image and non-image areas, will result in proper control of the direction of charge flow for creating the desired latent image in the toner layer.

Figure 2:
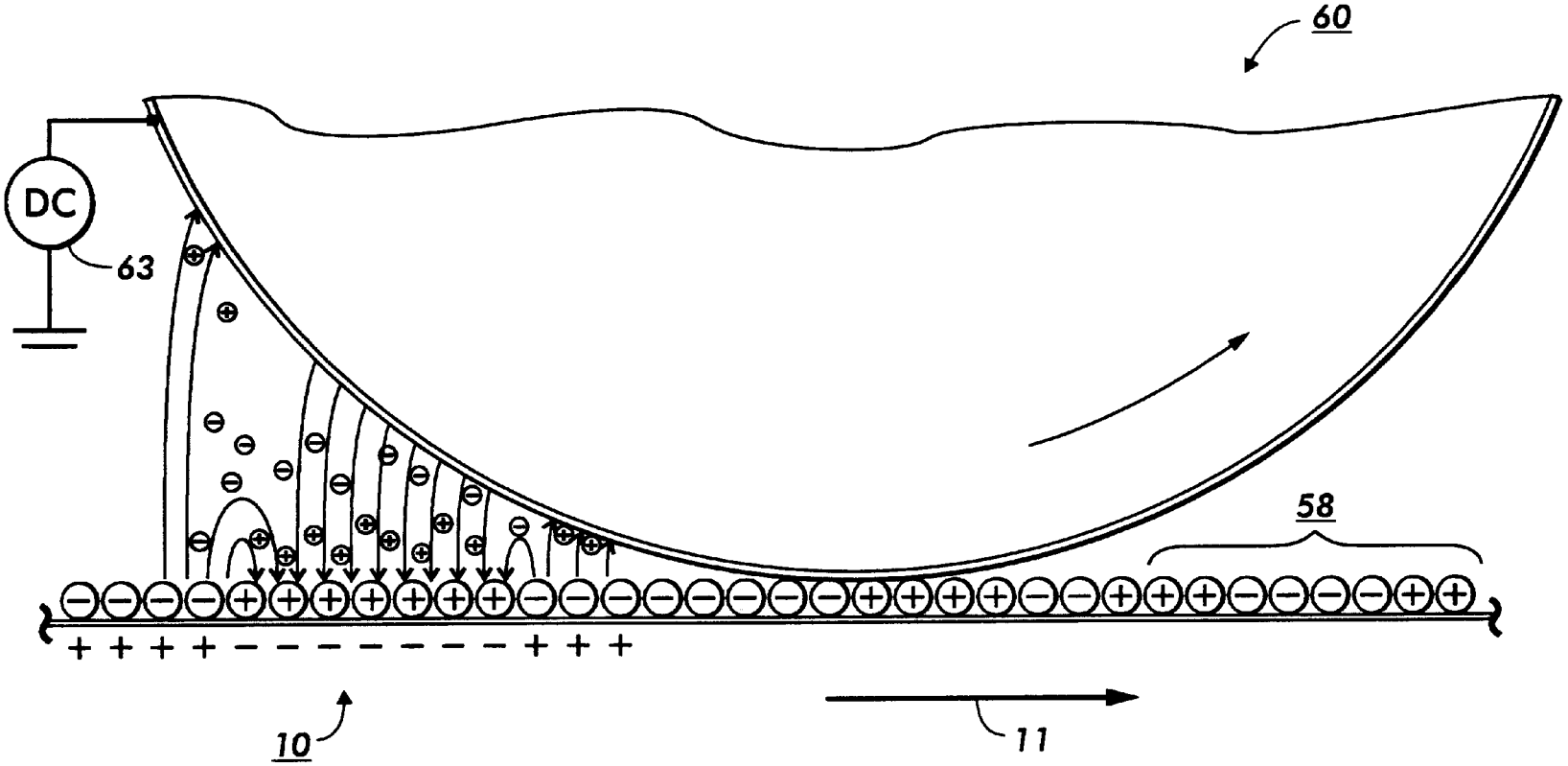
FIG. 2 is an exploded view illustrating image-wise charging of a toner layer via air breakdown, wherein a charged toner layer is selectively reverse charged in accordance with a latent image adjacent thereto, as contemplated by one embodiment of the present invention.

With respect to the process illustrated by FIG. 2, it will be seen that the function of the charging device 60 is to charge the toner layer 58 in an image-wise manner. This process will be described with respect to a negatively charged toner layer, although it will be understood that the process can also be implemented using a positively charged toner layer. In addition, the process of the present invention can also be implemented using an uncharged or neutral toner layer, as will be described in greater detail as the present description proceeds. In the case of a charged toner layer, the process of the present invention requires that, at a minimum, the air breakdown process provide ions having a charge opposite the toner layer charge polarity. In the case of a negatively charged toner layer 58, as shown in FIG. 2, the biased roll member 60 is provided with an energizing bias intermediate the potential of the image and non-image areas of the latent image on the imaging member 10 yet exceeding the Paschen threshold voltage so that positive ions will be generated and caused to flow in the direction of low potential areas of the latent image. Under certain circumstances, such as when the charge on the toner layer is sufficient to prevent charge reversal due to injected wrong sign charge, the energizing bias can be higher or lower than the bias of the image and non-image areas of the latent image. In addition, the energizing bias can be provided in the form of either a direct current (DC) electrical bias or an alternating current (AC) bias with or without a DC offset.

FIG. 2 illustrates the effect of the field lines in the case of a roll member energized by a DC voltage intermediate the charge potential associated with image and non image areas of the latent image, represented by (+) and (−) signs, respectively, on the back side of the imaging member 10. As illustrated, positive ions flow from the roll member 60, in the direction of the field lines, while negative ions (electrons) flow in a direction opposite to the direction of the field lines. The positive ions generated in the vicinity of a positively charged area (relative to the roll member bias potential) of the latent image are repelled from the toner layer 58 while the positive ions in the vicinity of a negatively charged area (relative to the roll member bias potential) of the latent image are attracted to the toner layer 58, and captured thereby. Conversely, negative ions generated in the vicinity of a positively charged area (relative to the roll member bias potential) of the latent image are attracted to the imaging member 10 and absorbed into the negatively charged toner 58, thereby enhancing toner charge in that area, while the negative ions in the vicinity of a negatively charged areas (relative to the roll member bias potential) of the latent image are repelled by the toner layer. The free flowing ions generated by the air breakdown induced ionization in the pre-nip region are captured by toner layer 58 in a manner corresponding to the latent image on the imaging member, causing image-wise charging of the toner layer 58, and creating a secondary latent image within the toner layer 58 that is charged opposite in charge polarity to the charge of the original latent image. Under optimum conditions, the charge associated with the original latent image will be converted into the secondary latent image in the toner layer 58 and/or absorbed by the charging roll 60 such that the voltage differential between which defines image and non-image areas in the original electrostatic latent image becomes substantially or completely dissipated.

In the above-described process, a charged toner layer 58 is situated on a latent image bearing imaging member 10, wherein the charged toner layer 58 is exposed to charged ions for selectively reversing the preexisting charge of the toner layer. Since the toner layer is initially charged, fringe fields, illustrated as field lines extending between image and non-image areas on the latent image can influence the charged toner cake. While the existence of these fringe fields may be advantageous if the fringe fields can be properly controlled, these fringe fields may manifest themselves as image quality defects in the final output document. Thus, the present invention contemplates an alternative embodiment to the image-wise toner layer charging process via air breakdown described hereinabove, wherein the fringe field effect may be substantially eliminated. In this alternative embodiment, the image-wise toner charging process of the present invention is carried out using a neutrally charged toner cake layer coated on the imaging member. In this case, roll member 60, or multiple roll members, present both negative and positive polarity ions to the toner layer in the vicinity of the latent image for oppositely charging regions of the toner layer corresponding to image and non image areas of the latent image. In an exemplary embodiment, an AC biasing source 63 is provided for energizing roll member 60 to provide ions of opposite polarity. Also, under appropriate conditions, as in the case of 2-way breakbown, as previously described, ions of both polarities can be generated. Alternatively, a combination of two independent roll members capable of providing opposite polarity ions can be used by biasing each roll member with independent, DC biasing sources.

Image-wise toner charging of a neutrally charged toner cake leads to another alternative embodiment for the present invention which is illustrated in FIG. 3. In this embodiment, air breakdown is induced in both the pre-nip and post-nip regions to provide the opposite charge polarity ions required to appropriately image-wise charge the neutral toner layer. This concept can be enabled by a segmented bias roll member of the type well known in the art and disclosed generally in U.S. Pat. No. 3,847,478, issued on Nov. 12, 1974, incorporated by reference herein. The segmented bias roll is provided with a plurality of discrete conductive electrodes 61, with each electrode being independently biased or energized via independent conductive shoe members 62 which are further coupled to independent biasing sources 63. In the embodiment illustrated in FIG. 3, the segmented bias roll member 62 is provided with a positive DC bias relative to the latent image in the pre-nip region and a negative DC bias relative to the latent image in the post-nip region.

It will be recognized that the bias voltage applied to the roll member 60 is not required to be intermediate the potentials associated with the image and non-image areas of the original latent image on the imaging member. Rather, a voltage which causes air breakdown relative to only one of either the image or non-image areas may be applied to the roll member. Thus, in the exemplary embodiment of FIG. 3, the conductive shoes 62 are each independently driven by independent DC biasing sources 62 to induce image-wise air breakdown which generates oppositely charged ion streams in opposite directions. This embodiment operates in a manner similar to the embodiment of FIG. 2, wherein positive ions generated by air breakdown in the post-nip region in the vicinity of a positively charged area of the latent image are repelled by the underlying latent image, while the positive ions in the vicinity of negatively charged areas of the latent image are attracted to the imaging member 10 and captured by the neutrally charged toner layer. Conversely, negative ions generated in the pre and post nip regions between the member 60 and the imaging member 10 are absorbed by the neutral toner particles adjacent positively charged areas of the latent image, while negative ions in the vicinity of a negatively charged areas of the latent image are repelled by the latent image. Thus, the free flowing ions generated by the roll member 60 in the pre and post nip regions are selectively captured by toner layer 58 in accordance with the charge of the latent image areas on the imaging member 10. This process induces image-wise charging of the toner layer 58, creating a secondary latent image within toner layer 58 made up of image and background areas which are charged oppositely with respect to the charge of the original latent image on the imaging member 10. Once again, under optimum conditions, the charge of the original latent image is converted into the secondary latent image in the toner layer and/or absorbed by the roll member 60 such that the original electrostatic latent image is substantially or completely dissipated into the toner layer after the image-wise toner charging process is complete.

It is noted that, after the secondary latent image is formed in the toner layer, the latent image bearing toner layer is advanced to the image separator 20. Thus, referring back to FIG. 1, image separator 20 may be provided in the form of a second biased roll member having a surface adjacent to the surface of the imaging member 10 and preferably contacting the toner layer 58 residing on image bearing member 10. An electrical biasing source is coupled to the image separator 20 to bias the image separator 20 so as to attract either image or non-image areas of the latent image formed in the toner layer 58 for simultaneously separating and developing the toner layer 58 into image and non-image portions. In the embodiment of FIG. 1, the image separator 20 is biased with a polarity opposite the charge polarity of the image areas in the toner layer 58 for attracting image areas therefrom, thereby producing a developed image made up of separated image and transferred portions of the toner cake on the surface of the image separator 20, while leaving background image byproduct on the surface of the imaging member 10. Alternatively, the image separator 20 can be provided with an electrical bias having a polarity appropriate for attracting non-image areas away from the imaging member 10, thereby maintaining toner portions corresponding to image areas on the surface of the imaging member, yielding a developed image thereon, while selectively separating and transferring non-image or background areas to the image separator 20.

After the developed image is created, either on the surface of the imaging member 10 or on the surface of the imaging separator 20, the developed image may then be transferred to a copy substrate 70 via any means known in the art, which may include an electrostatic transfer apparatus including a corona generating device of the type previously described or a biased transfer roll. Alternatively, a pressure transfer system may be employed which may include a heating and/or chemical application device for assisting in the pressure transfer and fixing of the developed image on the output copy substrate 70. In yet another alternative, image transfer can be accomplished via surface energy differentials wherein the surface energy between the image and the member supporting the image prior to transfer is lower than the surface energy between the image and the substrate 70, inducing transfer thereto. In a preferred embodiment, as shown in FIG. 1, the image is transferred to a copy substrate via a heated pressure roll, whereby pressure and heat are simultaneously applied to the image to simultaneously transfer and fuse the image to the copy substrate 70. It will be understood that separate transfer and fusing systems may be provided, wherein the fusing or so-called fixing system may operate using heat (by any means such as radiation, convection, conduction, induction, etc.), or other known fixation process which may include the introduction of a chemical fixing agent. Since the art of electrostatographic printing is well known, it is noted that several concepts for transfer and/or fusing which could be beneficially used in combination with the image-wise charging system of the present invention have been disclosed in the relevant patent literature.

In a final step in the process the background image byproduct on either the imaging member 10 or the image separator 20 is removed from the surface thereof in order to clean the surface in preparation for a subsequent imaging cycle. FIG. 1 illustrates a simple blade cleaning apparatus for scraping the imaging member surface as is well known in the art. Alternative embodiments may include a brush or roller member for removing toner from the surface on which it resides. In a preferred embodiment the removed toner associated with the background image is transported to a toner sump or other reclaim vessel so that the waste toner can be recycled and used again to produce the toner cake in subsequent imaging cycles. Once again, it is noted that several concepts for cleaning and toner reclaim which could be beneficially used in combination with the image-wise charging system of the present invention have been disclosed in the relevant patent literature.

It will be understood that the apparatus and processes described hereinabove represent only a few of the numerous system variants that could be implemented in the practice of the present invention. One particular variant printing system incorporating the teaching of the present invention will be described with respect to FIG. 4, wherein a negatively charged toner cake is provided on the surface of an imaging member 10.

The negatively charged toner layer deposited on the imaging member 10 is advanced directly to image separator 20 which is electrically biased to perform the same function as biased roll member 60. Thus, in this embodiment, the image separator roll is biased sufficiently for inducing air breakdown in the pre-nip region to cause image-wise charging of the toner layer 58 in a manner similar to that described with respect to the pre-nip region shown in FIG. 3. Thereafter, the image and non-image areas of the image-wise charged toner layer are separated in the post-nip region in a manner as previously described with respect to image separator 20. It will be understood that the process of this embodiment may be implemented via the application of an electrical bias to separator 20 using a single biasing source as shown in FIG. 1, or using a dual biasing source/segmented bias roll scheme as described with respect to FIG. 3.

In an exemplary embodiment illustrating the practice of the present invention in accordance with the embodiment of FIG. 4, a photoreceptive member is initially charged to −500 volts and thereafter selectively discharged to 0 volts for producing an electrostatic latent image thereon. Negatively charged toner particles immersed in a liquid carrier medium applied to the surface of the photoreceptive member to form a negatively charged, high solid content, toner layer thereon. The Paschen threshold in this case is 600 volts. The image separator is biased to +500 volts, wherein air breakdown occurring only in the areas where the original charge potential of −500 volts remains on the photoreceptive member causes positive ions to be attracted to the photoreceptive member. These positive ions are captured in the toner layer to change that portion of the toner layer to a positively charged latent image area. Thereafter, the +500 volts applied to the image separator operates to attract negatively charged portions of the latent image in the post nip region so as to develop the latent image associated with the toner layer by selectively separating portions thereof from the imaging member. Since the latent image on the imaging member dissipates as a function of the air breakdown process, no air breakdown occurs in the post nip region where image separation occurs. The foregoing process has been demonstrated to produce very high resolution images with substantially undeveloped background image development.

In review, the present invention provides a novel image development method and apparatus, whereby image-wise charging is accomplished by air breakdown such that free mobile ions are introduced in the vicinity of an electrostatic latent image coated with a layer of developing material. The latent image causes the free mobile ions to flow in an image-wise ion stream corresponding to the latent image, which, in turn, leads to image-wise charging of the toner layer, such that the toner layer itself becomes the latent image carrier. The latent image carrying toner layer is subsequently developed and transferred to a copy substrate to produce an output document.

It is, therefore, evident that there has been provided, in accordance with the present invention an image-wise toner layer charging system via air breakdown for image development and transfer that fully satisfies the aspects of the invention hereinbefore set forth. While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. An imaging apparatus, comprising:

an imaging member for having an electrostatic latent image formed thereon, said imaging member having a surface capable of supporting toner particles;

an imaging device for generating the electrostatic latent image on said imaging member, wherein the electrostatic latent image includes image areas defined by a first charge voltage and non-image areas defined by a second charge voltage distinguishable from the first charge voltage;

a toner supply apparatus for depositing toner particles on the surface of said imaging member to form a toner layer thereon adjacent the electrostatic latent image on said imaging member;

a biased member for inducing air breakdown to create an electrical discharge in the vicinity of the toner layer on the latent image bearing imaging member, wherein the electrical discharge selectively delivers charged ions to the toner layer in response to the electrostatic latent image on said imaging member to form a secondary latent image in the toner layer having image and non-image areas corresponding to the electrostatic latent image on said imaging member; and a separator member for selectively separating and transferring portions of the toner layer thereto in accordance with the secondary latent image in the toner layer to create a developed image corresponding to the electrostatic latent image formed on said imaging member.

2. The imaging apparatus of claim 1, wherein said imaging member includes a photosensitive imaging substrate.

3. The imaging apparatus of claim 1, wherein said imaging member includes a dielectric substrate.

4. The imaging apparatus of claim 1, wherein said imaging member includes a support surface and an electroded substructure capable of generating charged latent image areas.

5. The imaging apparatus of claim 2, further including a charging device for applying an electrostatic charge potential to said photosensitive imaging substrate.

6. The imaging apparatus of claim 5, wherein said imaging device includes an image exposure device for projecting a light image onto the photosensitive imaging substrate to generate the electrostatic latent image.

7. The imaging apparatus of claim 1, wherein said toner supply apparatus is adapted to deposit a layer of uncharged toner particles on the surface of said imaging member.

8. The imaging apparatus of claim 1, wherein said toner supply apparatus is adapted to deposit a layer of electrically charged toner particles on the surface of said imaging member.

9. The imaging apparatus of claim 1, wherein said toner supply apparatus is adapted to deposit a toner layer having a thickness of approximately 2 to 15 microns on the surface of said imaging member.

10. The imaging apparatus of claim 9, wherein said toner supply apparatus deposits a toner layer on the surface of said imaging member having a thickness in a range between approximately 3 and 8 microns.

11. The imaging apparatus of claim 1, wherein said toner supply apparatus is adapted to accommodate liquid developing material including toner particles immersed in a liquid carrier medium.

12. The imaging apparatus of claim 11, wherein said toner supply apparatus is adapted to deposit a toner layer having a toner solids percentage by weight of at least approximately 10%.

13. The imaging apparatus of claim 11, wherein said toner supply apparatus is adapted to deposit a toner layer having a toner solids percentage by weight in a range between approximately 15% and 35%.

14. The imaging apparatus of claim 1, wherein said toner supply apparatus is adapted to supply a toner layer having a substantially uniform density onto the surface of the imaging member.

15. The imaging apparatus of claim 1, wherein said toner supply apparatus includes:

a housing adapted to accommodate a supply of toner particles therein; and a rotatably mounted applicator roll member for transporting toner particles from said housing to the surface of said imaging member.

16. The imaging apparatus of claim 15, wherein said toner supply apparatus further includes an electrical biasing source coupled to said applicator roll member for applying an electrical bias thereto to generate electrical fields between said applicator roll and said imaging member so as assist in forming the toner layer on the surface of said imaging member.

17. The imaging apparatus of claim 1, wherein said toner supply apparatus includes a fountain-type applicator assembly for transporting a flow of toner particles into contact with the surface of said imaging member.

18. The imaging apparatus of claim 17, wherein said toner supply apparatus further includes a metering roll for applying a shear force to the toner layer on the surface of said imaging member to control thickness thereof.

19. The imaging apparatus of claim 1, wherein said biased member is adapted to introduce free mobile ions in a vicinity of the imaging member having the electrostatic latent image and the toner layer supported thereon, for creating an image-wise ion stream directed toward the toner layer responsive to the electrostatic latent image on the imaging member.

20. The imaging apparatus of claim 19, further including a DC biasing source coupled to said biased member for providing a biasing voltage to said biased member to selectively generate ions having a single charge polarity or both charge polarities in the vicinity of the imaging member having the electrostatic latent image and the toner layer supported thereon.

21. The imaging apparatus of claim 19, further including an AC biasing source coupled to said biased member for providing a biasing voltage to said biased member to selectively generate ions having a single charge polarity or both charge polarities in the vicinity of the imaging member having the electrostatic latent image and the toner layer supported thereon.

22. The imaging apparatus of claim 21, further including a DC biasing source coupled to said biased member for providing a DC offset to the biasing voltage.

23. The imaging apparatus of claim 1, further including an electrical biasing source coupled to said biased member for providing a biasing voltage thereto intermediate the first and second charge voltages associated with the electrostatic latent image generated on the imaging member.

24. The imaging apparatus of claim 1, further including an electrical biasing source coupled to said biased member having a biasing voltage thereto greater than the first and second charge voltages associated with the electrostatic latent image generated on the imaging member.

25. The imaging apparatus of claim 1, wherein said biased member includes a segmented biased member.

26. The imaging apparatus of claim 25, wherein said segmented biased member includes:

a plurality of electrically discrete conductive electrodes internal to said biased member; and at least one conductive shoe coupled to a biasing source for energizing selected areas of said plurality of electrodes.

27. The imaging apparatus of claim 1, wherein said separator member is adapted to attract toner layer image areas associated with the secondary latent image away from the imaging member so as to maintain toner layer non-image areas associated with the secondary latent image on the surface of the imaging member.

28. The imaging apparatus of claim 1, wherein said separator member is adapted to attract toner layer non-image areas associated with the secondary latent image away from the imaging member so as to maintain toner layer image areas associated with the secondary latent image on the surface of the imaging member.

29. The imaging apparatus of claim 1, wherein said separator member includes a peripheral surface for contacting the toner layer to selectively attract portions thereof away from the imaging member.

30. The imaging apparatus of claim 29, wherein said separator member includes an electrical biasing source coupled to said peripheral surface for electrically attracting selectively charged portions of the toner layer.

31. The imaging apparatus of claim 1, further including a transfer system for transferring the developed image to a copy substrate to produce an output copy thereof.

32. The imaging apparatus of claim 31, wherein said transfer system further includes a system for substantially simultaneously fixing the image to the copy substrate.

33. The imaging apparatus of claim 31, further including a fusing system for fusing the transferred image to the copy substrate.

34. The imaging apparatus of claim 27, further including a cleaning apparatus for removing toner layer non-image areas associated with the secondary latent image from the surface of said imaging member.

35. The imaging apparatus of claim 28, further including a cleaning apparatus for removing toner layer non-image areas associated with the secondary latent image from the surface of said separator member.

36. An imaging process, comprising the steps of:

generating an electrostatic latent image on an imaging member having a surface capable of supporting toner particles, wherein the electrostatic latent image includes image areas defined by a first charge voltage and non-image areas defined by a second charge voltage distinguishable from the first charge voltage;

depositing toner particles on the surface of said imaging member to form a toner layer thereon adjacent the electrostatic latent image on said imaging member;

inducing air breakdown to create an electrical discharge in the vicinity of the toner layer on the latent image bearing imaging member, wherein the electrical discharge selectively delivers charged ions to the toner layer in response to the electrostatic latent image on said imaging member to form a secondary latent image in the toner layer having image and non-image areas corresponding to the electrostatic latent image on said imaging member; and selectively separating and transferring portions of the toner layer thereto in accordance with the secondary latent image in the toner layer to create a developed image corresponding to the electrostatic latent image formed on said imaging member.

37. The imaging process of claim 36, wherein said electrostatic latent image generating step includes:

charging a photosensitive imaging substrate; and selectively dissipating the charge on the photosensitive imaging substrate in accordance with the image and non-image areas.

38. The imaging process of claim 36, wherein said electrostatic latent image generating step includes:

selectively depositing electrical charge on a dielectric imaging member in accordance with the image and non-image areas.

39. The imaging process of claim 36, wherein said toner particle depositing step includes depositing a layer of uncharged toner particles on the surface of the imaging member.

40. The imaging process of claim 36, wherein said toner particle depositing step includes depositing a layer of charged toner particles on the surface of the imaging member.

41. The imaging process of claim 36, wherein said toner particle depositing step includes forming a toner layer having a thickness of approximately 2 to 15 microns on the surface of said imaging member.

42. The imaging process of claim 41, wherein said toner particle depositing step includes forming a toner layer having a thickness in a range between approximately 3 and 8 microns on the surface of the imaging member.

43. The imaging process of claim 36, wherein said toner particle depositing step includes depositing liquid developing material including toner particles immersed in a liquid carrier medium.

44. The imaging process of claim 43, wherein said toner particle depositing step is adapted to deposit a toner layer having a toner solids percentage by weight of at least approximately 10%.

45. The imaging process of claim 44, wherein said toner particle depositing step is adapted to deposit a toner layer having a toner solids percentage by weight in a range between approximately 15% and 35%.

46. The imaging process of claim 36, wherein said toner particle depositing step is adapted to deposit a toner layer having a substantially uniform density onto the surface of the imaging member.

47. The imaging process of claim 36, wherein said air breakdown step is adapted to introduce free mobile ions in the vicinity of the imaging member having the electrostatic latent image and the toner layer supported thereon, for creating an image-wise ion stream directed toward the toner layer responsive to the electrostatic latent image on the imaging member.

48. The imaging process of claim 47, wherein said air breakdown inducing step is adapted to generate ions having a single charge polarity in the vicinity of the imaging member having the electrostatic latent image and the toner layer supported thereon.

49. The imaging process of claim 47, wherein said air breakdown inducing step is adapted to generate ions having first and second charge polarities in the vicinity of the imaging member having the electrostatic latent image and the toner layer supported thereon.

50. The imaging process of claim 36, wherein said air breakdown inducing step further includes a step for providing a biasing voltage intermediate the first and second charge voltages associated with the electrostatic latent image generated on the imaging member.

51. The imaging process of claim 36, wherein said air breakdown inducing step further includes a step for providing a biasing voltage greater than the first and second charge voltages associated with the electrostatic latent image generated on the imaging member.

52. The imaging process of claim 36, wherein said air breakdown inducing step further includes:

a first step for generating ions having a first charge polarity in the vicinity of the imaging member having the electrostatic latent image and the toner layer supported thereon; and a second step for generating ions having a second charge polarity in the vicinity of the imaging member having the electrostatic latent image and the toner layer supported thereon.

53. The imaging process of claim 36, wherein said step of selectively separating portions of the toner layer from the imaging member includes the step of attracting toner layer image areas associated with the secondary latent image away from the imaging member so as to maintain toner layer non-image areas associated with the secondary latent image on the surface of the imaging member.

54. The imaging process of claim 36, wherein said step of selectively separating portions of the toner layer from the imaging member includes the step of attracting toner layer non-image areas associated with the secondary latent image away from the imaging member so as to maintain toner layer image areas associated with the secondary latent image on the surface of the imaging member.

55. The imaging process of claim 36, wherein said step of selectively separating portions of the toner layer from the imaging member includes providing a member having a peripheral surface for contacting the toner layer to selectively attract portions thereof away from the imaging member.

56. The imaging process of claim 55, wherein said step of selectively separating portions of the toner layer from the imaging member further includes providing an electrical bias to the member having a peripheral surface for contacting the toner layer to electrically attract selectively charged portions of the toner layer away from the imaging member.

57. The imaging process of claim 36, further including a transfer step for transferring the developed image to a copy substrate to produce an output copy thereof.

58. The imaging process of claim 57, wherein said transfer step further includes the step of substantially simultaneously fixing the image to the copy substrate.

59. The imaging process of claim 57, further including a fusing step for fusing the transferred image to the copy substrate.

60. The imaging process of claim 53, further including a cleaning step for removing toner layer non-image areas associated with the secondary latent image from the surface of said imaging member.

61. The imaging process of claim 54, further including a cleaning step for removing toner layer non-image areas associated with the secondary latent image from another surface of a separator member.

62. The imaging process of claim 36, wherein said step of generating an electrostatic latent image on an imaging member precedes said step of depositing toner particles on the surface of said imaging member.

63. The imaging process of claim 36, wherein said step of generating an electrostatic latent image on an imaging member occurs subsequent to said step of depositing toner particles on the surface of said imaging member.

64. An image development apparatus for developing an electrostatic latent image formed on an imaging member, comprising:

means for depositing a layer of marking particles on the imaging member;

means for inducing air breakdown creating an electrical discharge in a vicinity of the layer of marking particles on the imaging member to selectively charge the layer of marking particles in response to the electrostatic latent image on the imaging member so as to create a second electrostatic latent image in the layer of marking particles; and means for selectively separating portions of the layer of marking particles in accordance with the second latent image for creating a developed image corresponding to the electrostatic latent image formed on the imaging member.

65. The image development apparatus of claim 64, wherein the layer of marking particles on the imaging member includes uncharged toner particles.

66. The image development apparatus of claim 64, wherein the layer of marking particles on the imaging member includes electrically charged toner particles.

67. The image development apparatus of claim 64, wherein the layer of marking particles on the imaging member has a thickness of approximately 2 to 15 microns.

68. The image development apparatus of claim 67, wherein the layer of marking particles on the imaging member has a thickness in a range between approximately 3 and 8 microns.

69. The image development apparatus of claim 64, wherein the layer of marking particles on the imaging member comprises liquid developing material including toner particles immersed in a liquid carrier medium.

70. The image development apparatus of claim 69, wherein the liquid developing material includes a toner solids percentage by weight of at least approximately 10%.

71. The image development apparatus of claim 70, wherein the liquid developing material includes a toner solids percentage by weight in a range between approximately 15% and 35%.

72. The image development apparatus of claim 64, wherein the layer of marking particles on the imaging member has a substantially uniform thickness.

73. The image development apparatus of claim 64, wherein said means for creating an electrical discharge provides free mobile ions proximate to the imaging member having the electrostatic latent image and the toner layer supported thereon for creating an image-wise ion stream directed toward the electrostatic latent image on the imaging member.

74. The image development apparatus of claim 73, wherein said means for creating an electrical discharge includes a DC biasing source for creating an image-wise ion stream having a single charge polarity.

75. The image development apparatus of claim 73, wherein said means for creating an electrical discharge includes an AC biasing source for creating an image-wise ion stream having first and second charge polarities.

76. The image development apparatus of claim 64, wherein said selective separating means removes image areas of the second latent image in the layer of marking particles so as to maintain non-image areas of the second latent image in the layer of marking particles on the surface of the imaging member.

77. The image development apparatus of claim 64, wherein said selective separating means removes non-image areas of the second latent image in the layer of marking particles so as to maintain image areas of the second latent image in the layer of marking particles on the surface of the imaging member.

78. An image development apparatus for developing an electrostatic latent image formed on an imaging member, comprising:

means for depositing a layer of marking particles on the imaging member;

means for inducing air breakdown creating an electrical discharge in a vicinity of the layer of marking particles on the imaging member to selectively charge the layer of marking particles in response to the electrostatic latent image on the imaging member so as to create a second electrostatic latent image in the layer of marking particles and including a segmented biased member; and means for selectively separating portions of the layer of marking particles in accordance with the second latent image for creating a developed image corresponding to the electrostatic latent image formed on the imaging member.

79. The image development apparatus of claim 78, wherein said segmented biased member includes:

a plurality of electrically discrete conductive electrodes internal to said biased member; and at least one conductive shoe coupled to a biasing source for energizing selected areas of said plurality of electrodes.

80. An image development apparatus for developing an electrostatic latent image formed on an imaging member, comprising:

means for depositing a layer of marking particles on the imaging member;

means for inducing air breakdown creating an electrical discharge in a vicinity of the layer of marking particles on the imaging member to selectively charge the layer of marking particles in response to the electrostatic latent image on the imaging member so as to create a second electrostatic latent image in the layer of marking particles; and means for selectively separating portions of the layer of marking particles in accordance with the second latent image for creating a developed image corresponding to the electrostatic latent image formed on the imaging member, and including a peripheral surface for contacting the layer of marking particles to selectively attract portions thereof away from the imaging member.

81. An image development process for developing an electrostatic latent image formed on an imaging member, comprising the steps of:

depositing a layer of marking particles on the imaging member;

inducing air breakdown for selectively charging the layer of marking particles in response to the electrostatic latent image to create a second electrostatic latent image in the layer of marking particles corresponding to the electrostatic latent image on the imaging member; and selectively separating portions of the layer of marking particles in accordance with the second latent image for creating a developed image.

82. The image development process of claim 81, wherein the layer of marking particles on the imaging member includes uncharged toner particles.

83. The image development process of claim 81, wherein the layer of marking particles on the imaging member includes electrically charged toner particles.

84. The image development process of claim 81, wherein the step of depositing a layer of marking particles on the imaging member includes the step of depositing a substantially uniform thickness of marking particles onto the imaging member.

85. The image development process of claim 81, wherein said air breakdown inducing step includes directing an image-wise ion stream to the electrostatic latent image on the imaging member having the layer of marking particles supported thereon such that ions are captured in an image-wise manner by the layer of marking particles on the imaging member to create the second latent image therein.

86. The image development process of claim 85, wherein said air breakdown inducing step includes creating an image-wise ion stream having a single charge polarity.

87. The image development process of claim 85, wherein said air breakdown inducing step includes creating an image-wise ion stream having first and second charge polarities.

88. The image development process of claim 81, wherein said selective separating step includes the step of removing image areas of the second latent image form the layer of marking particles so as to maintain non-image areas of the second latent image in the layer of marking particles on the surface of the imaging member.

89. The image development process of claim 81, wherein said selective separating step includes the step of removing non-image areas of the second latent image in the layer of marking particles so as to maintain image areas of the second latent image in the layer of marking particles on the surface of the imaging member.

90. An image development apparatus, comprising:

means for generating a first electrostatic latent image on an imaging member, wherein the electrostatic latent image includes image and non-image areas having distinguishable charge potentials; and means, including a bias roll member, for generating a second electrostatic latent image on a toner layer situated adjacent the first electrostatic latent image on the imaging member, wherein the second electrostatic latent image includes image and non-image areas having distinguishable charge potentials of a polarity opposite to the charge potentials of the charged image and non-image areas in the first electrostatic latent image.

91. A process for image development, comprising the steps of:

generating a first electrostatic latent image on an imaging member, wherein the electrostatic latent image includes image and non-image areas having distinguishable charge potentials; and inducing air breakdown in the vicinity of a toner layer situated adjacent the first electrostatic latent image for generating a second electrostatic latent image in the toner layer, wherein the second electrostatic latent image includes image and non-image areas having distinguishable charge potentials of a polarity opposite to the charge potentials of the charged image and non-image areas in the first electrostatic latent image.

* * * * *